US006065619A

United States Patent [19]

Miyata et al.

[11] Patent Number: 6,065,619

[45] Date of Patent: May 23, 2000

[54] CARGO HANDLING PATH SETTING METHOD AND APPARATUS FOR CRANE

[75] Inventors: Noriaki Miyata; Takashi Toyohara, both of Hiroshima, Japan

[73] Assignee: Mitsubishi Heavy Industries, Ltd., Japan

[21] Appl. No.: 08/987,274

[22] Filed: Dec. 9, 1997

[30] Foreign Application Priority Data

Dec. 10, 1996 [JP] Japan ..... 8-329314

[51] Int. Cl.[7] ..... B66C 13/48

[52] U.S. Cl. ..... 212/286; 340/685; 212/270

[58] Field of Search ..... 212/276, 286, 212/270, 271; 414/803; 340/685

[56] References Cited

U.S. PATENT DOCUMENTS 4,753,357 6/1988 Miyoshi et al. .
5,505,585 4/1996 Hubbard ..... 414/803

FOREIGN PATENT DOCUMENTS 4403898 8/1994 Germany .
4405525 8/1995 Germany .
19502421 8/1996 Germany .
91/14644 10/1991 WIPO ..... 212/286

*Primary Examiner*—Thomas J. Brahan
*Attorney, Agent, or Firm*—Rothwell, Figg, Ernst & Kurz, p.c.

[57] ABSTRACT

A cargo handling path setting method and apparatus determine arbitrary hoisting and lowering speeds of a suspended load and the times required for hoisting and lowering to set hoisting and lowering speed patterns, determine an arbitrary traversing speed of the suspended load and the time required for traversing to set a traversing speed pattern, set the positions and heights of obstacles present around the cargo handling path based on data from stacked load sensors, and further set an arbitrary waiting time for traversing and an arbitrary waiting time for lowering; then conduct a theoretical simulation test based on these set conditions to compute a cargo handling path, and if it is determined that the suspended load passing along the cargo handling path will collide with the obstacles, repeat the procedure of revising the set conditions and conducting a theoretical simulation test again. Thus, an optimum cargo handling path is set by which the suspended load can be carried to a predetermined place in the shortest time required by its simultaneous winding/traversing operation without its collision with the obstacles.

6 Claims, 10 Drawing Sheets

CARGO HANDLING PATH SETTING METHOD AND APPARATUS FOR CRANE

BACKGROUND OF THE INVENTION

This invention relates to a cargo handling path setting method and apparatus for a crane, which are useful when applied to efficient cargo handling by performing a so-called simultaneous winding/traversing operation of a suspended load in which the suspended load is hoisted or lowered and traversed simultaneously.

FIG. 11 is an explanation drawing showing a conventional method for operating a crane. As illustrated in this drawing, a girder 2 is supported by legs 1 and provided horizontally. The girder 2 is provided with a trolley 3. The trolley 3 traverses along the girder 2 in the right-and-left direction in the drawing, and has a wire rope 4 for suspending a load and a wire drum (not shown) By rotationally driving the wire drum, a suspended load is hoisted and lowered.

With this crane, when a load n on a location (a) in FIG. 11 is to be carried to a location (b) over stacked loads n lying in the way, the load n is suspended at the location (a) by thewire rope 4. Then, the load n is hoisted by the wire drum, and traversed along with the trolley. Further, the load n is lowered by the wire drum, and placed on the floor at the location (b).

For the automatic operation of the crane, a so-called right-angled operation is available in which the hoisting of the suspended load n, the traversing of the trolley 3 (i.e., the traversing of the suspended load n), and the lowering of the suspended load n are performed sequentially as individual actions. This type of operation is generally employed as a simple method.

FIG. 12 shows a hoisting speed pattern, a traversing speed pattern, and a lowering speed pattern in the right-angled operation. As shown in this drawing, speed control according to trapezoidal hoisting and lowering speed patterns is performed during hoisting and lowering actions, while steadying/positioning control according to a nearly trapezoidal traversing speed pattern (steadying/positioning control pattern) is performed during a traversing action.

In the right-angled operation, the traversing action is started after completion of the hoisting action, and the lowering action is started after completion of the traversing action. As shown in FIG. 11, therefore, a cargo handling path $l_0$ for the suspended load n takes a right-angled form. As shown in FIG. 12, the total required time $T_a$ is the sum of the time $T_1$ required for hoisting, the time $T_2$ required for traversing, and the time $T_3$ required for lowering. Accordingly, cargo handling work takes plenty of time.

To make up for this drawback of the right-angled operation, a so-called simultaneous winding/traversing operation may be performed in which hoisting or lowering and traversing actions are carried out at the same time. The conventional simultaneous winding/traversing operation, however, does not go beyond an anticipatory operation merely based on past experience. The conventional simultaneous winding/traversing operation, therefore, was minimally effective for time saving, and in some cases, posed the risk of the suspended load colliding with obstacles lying around the cargo handling path.

SUMMARY OF THE INVENTION

The present invention has been accomplished in the light of the above-described earlier technologies. Its object is to provide a cargo handling path setting method and apparatus for a crane which set an optimum cargo handling path where a suspended load can be carried to a predetermined place in the shortest time required by the simultaneous winding/traversing operation without the collision of the suspended load with obstacles.

An aspect of the present invention for attaining the above object is a cargo handling path setting method for a crane adapted to set an optimum cargo handling path for the simultaneous winding/traversing operation of a suspended load by a crane which hoists the suspended load by a hoisting/lowering structure, traverses the suspended load by a traversing structure, and lowers the suspended load by the hoisting/lowering structure to carry the suspended load to a predetermined place, the method comprising:

determining arbitrary hoisting and lowering speeds of the suspended load and the times required for hoisting and lowering to set hoisting and lowering speed patterns, determining an arbitrary traversing speed of the suspended load and the time required for traversing to set a traversing speed pattern, setting the positions and heights of obstacles present around the cargo handling path based on data from sensors, and further setting an arbitrary waiting time for traversing and an arbitrary waiting time for lowering; and then conducting a theoretical simulation test based on these set conditions to compute a cargo handling path, and if it is determined that the suspended load passing along the cargo handling path will collide with the obstacles, repeating the procedure of revising the set conditions and conducting a theoretical simulation test again;

thereby setting an optimum cargo handling path by which the suspended load can be carried to a predetermined place in the shortest time required without the collision of the suspended load with the obstacles.

Another aspect of the invention is a cargo handling path setting apparatus for a crane adapted to set an optimum cargo handling path for the simultaneous winding/traversing operation of a suspended load by a crane which hoists the suspended load by a hoisting/lowering structure, traverses the suspended load by a traversing structure, and lowers the suspended load by the hoisting/lowering structure to carry the suspended load to a predetermined place, the apparatus comprising:

a condition setter for determining arbitrary hoisting and lowering speeds of the suspended load and the times required for hoisting and lowering to set hoisting and lowering speed patterns, determining an arbitrary traversing speed of the suspended load and the time required for traversing to set a traversing speed pattern, setting the positions and heights of obstacles present around the cargo handling path based on data from sensors, and further setting an arbitrary waiting time for traversing and an arbitrary waiting time for lowering; and an arithmetic device for conducting a theoretical simulation test based on these set conditions to compute a cargo handling path, and if it is determined that the suspended load passing along the cargo handling path will collide with the obstacles, repeating the procedure of revising the set conditions and conducting a theoretical simulation test again, thereby setting an optimum cargo handling path by which the suspended load can be carried to a predetermined place in the shortest time required without the collision of the suspended load with the obstacles.

The foregoing cargo handling path setting method and apparatus for a crane, therefore, determine arbitrary hoisting and lowering speeds of the suspended load and the times required for hoisting and lowering to set hoisting and lowering speed patterns, determine an arbitrary traversing speed of the suspended load and the time required for traversing to set a traversing speed pattern, set the positions and heights of obstacles present around the cargo handling path based on data from sensors, and further set an arbitrary waiting time for traversing and an arbitrary waiting time for lowering; then conduct a theoretical simulation test based on these set conditions to compute a cargo handling path, and if it is determined that the suspended load passing along the cargo handling path will collide with the obstacles, repeat the procedure of revising the set conditions and conducting a theoretical simulation test again; thereby setting an optimum cargo handling path by which the suspended load can be carried to a predetermined place in the shortest time required without the collision of the suspended load with the obstacles. By applying this optimum cargo handling path to an actual operation, a suspended load can be carried to a predetermined place in the shortest time required by the simultaneous winding/traversing operation without the collision of the suspended load with obstacles. Thus, cargo handling can be carried out safely and efficiently.

DETAILED DESCRIPTION OF THE PREFERRED EMBODIMENTS

Embodiments of the present invention will now be described in detail with reference to the accompanying drawings. The same parts as in the related art will be assigned the same numerals, and overlapping detailed descriptions will be omitted.

Figure 1:
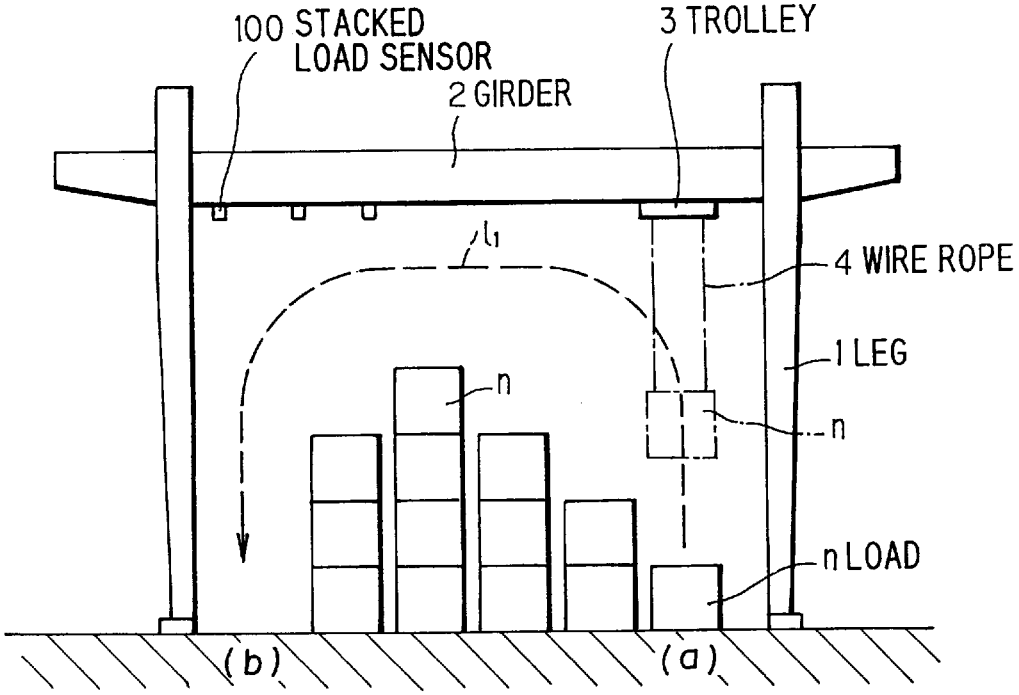
FIG. 1 is an explanation drawing showing an example of a simultaneous winding/traversing operation status of a crane to which a cargo handling path setting method (apparatus) related to an embodiment of the present invention is applied (Mode 1)
Figure 2:
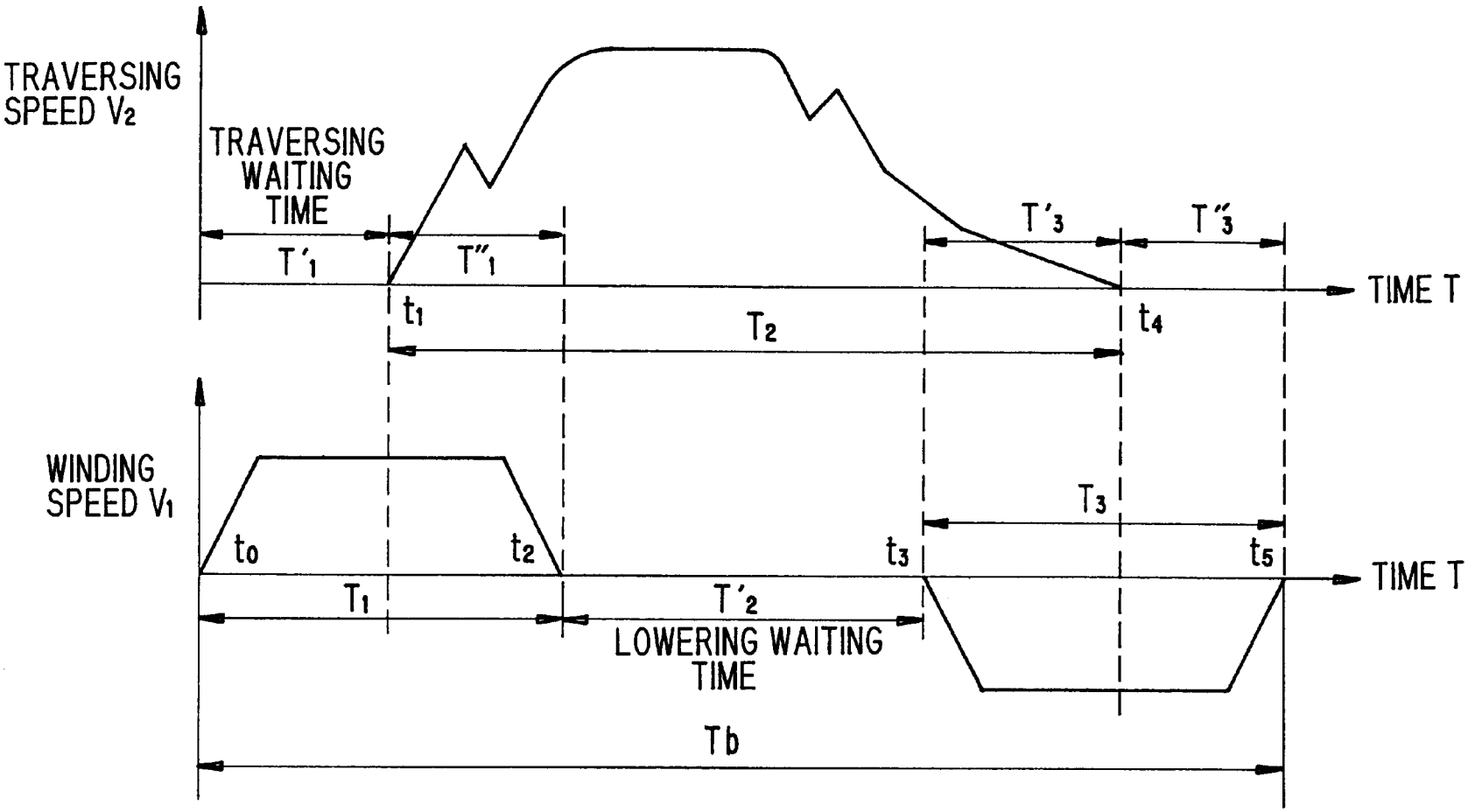
FIG. 2 is an explanation drawing of each speed pattern in the simultaneous winding/traversing operation of Mode 1 illustrated in FIG. 1.

FIG. 1 is an explanation drawing showing an example of a simultaneous winding/traversing operation status of a crane to which a cargo handling path setting method (apparatus) related to an embodiment of the present invention is applied (Mode 1). FIG. 2 is an explanation drawing of each speed pattern in the simultaneous winding/traversing operation of Mode 1 illustrated in FIG. 1.

Figure 11:
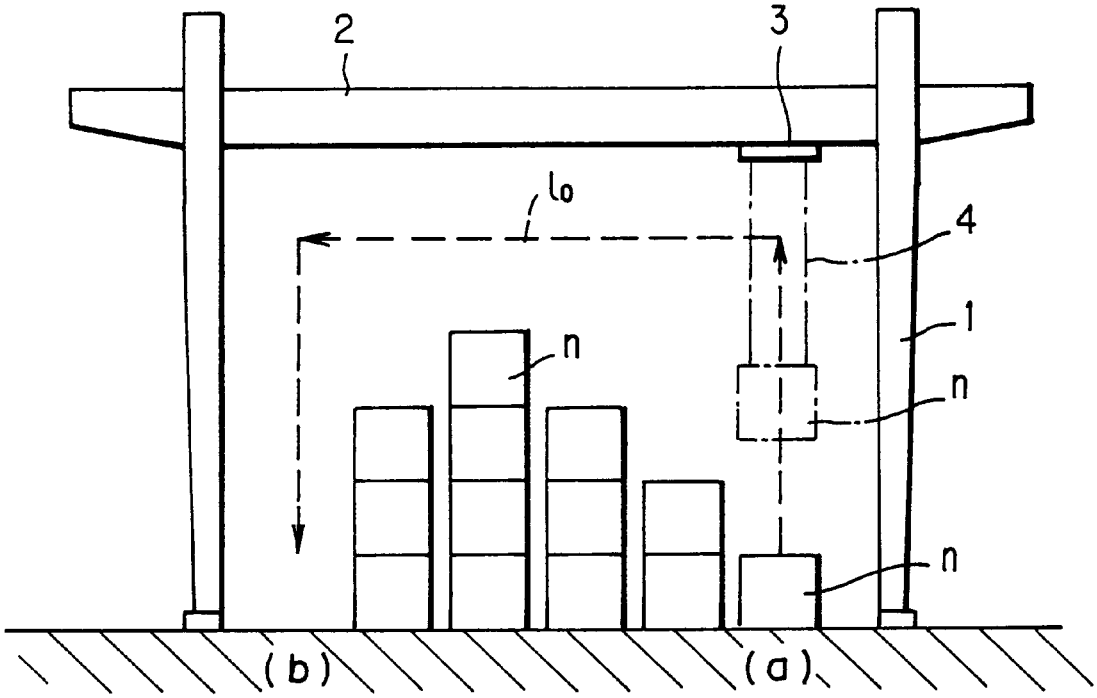
FIG. 11 Related Art
FIG. 11 is an explanation drawing of a conventional method for operating a crane.

As shown in FIG. 1, a crane, as in the related art (FIG. 11), has a girder 2, legs 1, and a trolley 3 having a wire drum and a wire rope 4. On the underside of the girder 2, a plurality of stacked load sensors 100 are suitably installed with a pitch of about 2.8 m.

In this crane, when a suspended load n is carried from a location (a) in FIG. 1 to a location (b) over stacked loads n, a so-called simultaneous winding/traversing operation is performed in which part of a hoisting action for the suspended load n and part of a traversing action for the trolley 3 (i.e., a traversing action for the suspended load n) are carried out simultaneously, and also part of a traversing action for the trolley 3 and part of a lowering action for the suspended load n are carried out simultaneously. A trajectory $\mathbf{1}_1$ in FIG. 1 represents the cargo handling path of the suspended load n in this situation.

FIG. 2 shows the hoisting speed pattern and the lowering speed pattern of the suspended load n (lower half of the drawing) and the traversing speed pattern (steadying/positioning control pattern) of the trolley 3 (suspended load n) (upper half of the drawing) in the simultaneous winding/traversing operation of the instant Mode 1.

As shown in this drawing, according to the simultaneous winding/traversing operation of Mode 1, a hoisting action for the suspended load n is started, and at a time point $t_1$ (a traversing waiting time $T_1'$) during this hoisting action, a traversing action for the trolley 3 (suspended load n) is started. Then, at a time point $t_2$ after a lapse of time $T_1''$, the hoisting action is completed. Thereafter, at a time point $t_3$ (a lowering waiting time $T_2'$) during the traversing action, a lowering action for the suspended load n is started. Afterwards, at a time point $t_4$ after a lapse of time $T_3'$, the traversing action is completed. Further, at a time point $t_5$ after a lapse of time $T_3''$, the lowering action is completed. In this manner, a cycle of actions for carrying the suspended load n is completed.

Figure 12:
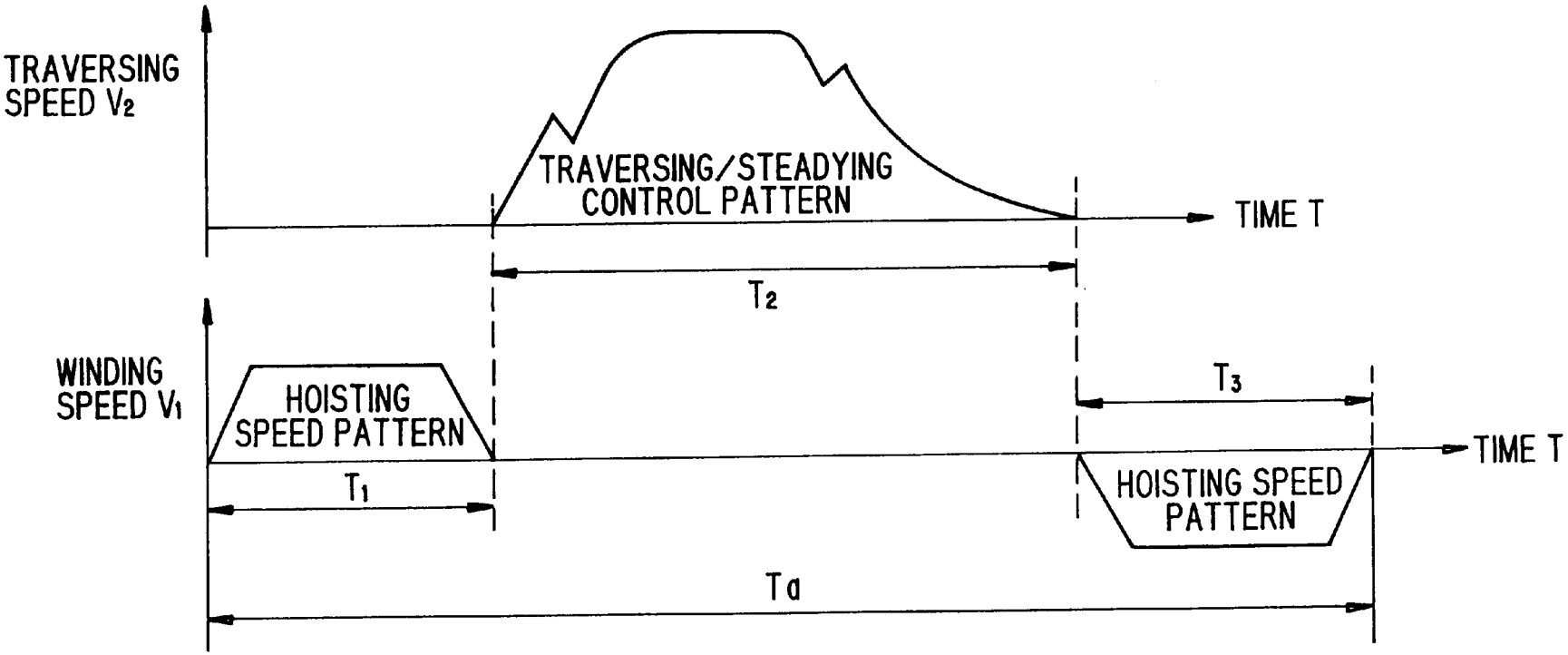
FIG. 12 Related Art
FIG. 12 is an explanation drawing of each speed pattern in the conventional method for operating a crane shown in FIG. 11.

Hence, the time $T_b$ required for this cycle of actions for carrying the suspended load n in the simultaneous winding/traversing operation of Mode 1 is the sum of the time $T_1$ required for hoisting, the lowering waiting time $T_2'$, and the time $T_3$ required for lowering. Comparing the time $T_b$ with the required time $T_a$ for the right-angled operation (see FIG. 12) shows that $T_b$ is shorter than $T_a$ by the sum of the time $T_1''$ during which the hoisting action and the traversing action are performed simultaneously, and the time $T_3'$ during which the traversing action and the lowering action are performed simultaneously.

Figure 3:
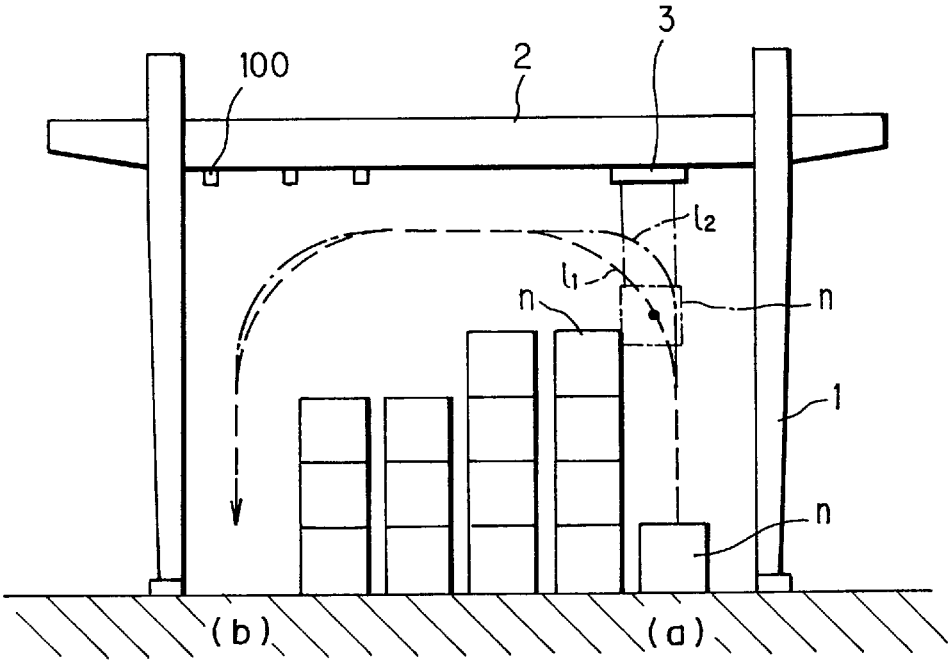
FIG. 3 is an explanation drawing showing another example of a simultaneous winding/traversing operation status of a crane to which a cargo handling path setting method (apparatus) related to the embodiment of the invention is applied (Mode 2)
Figure 4:
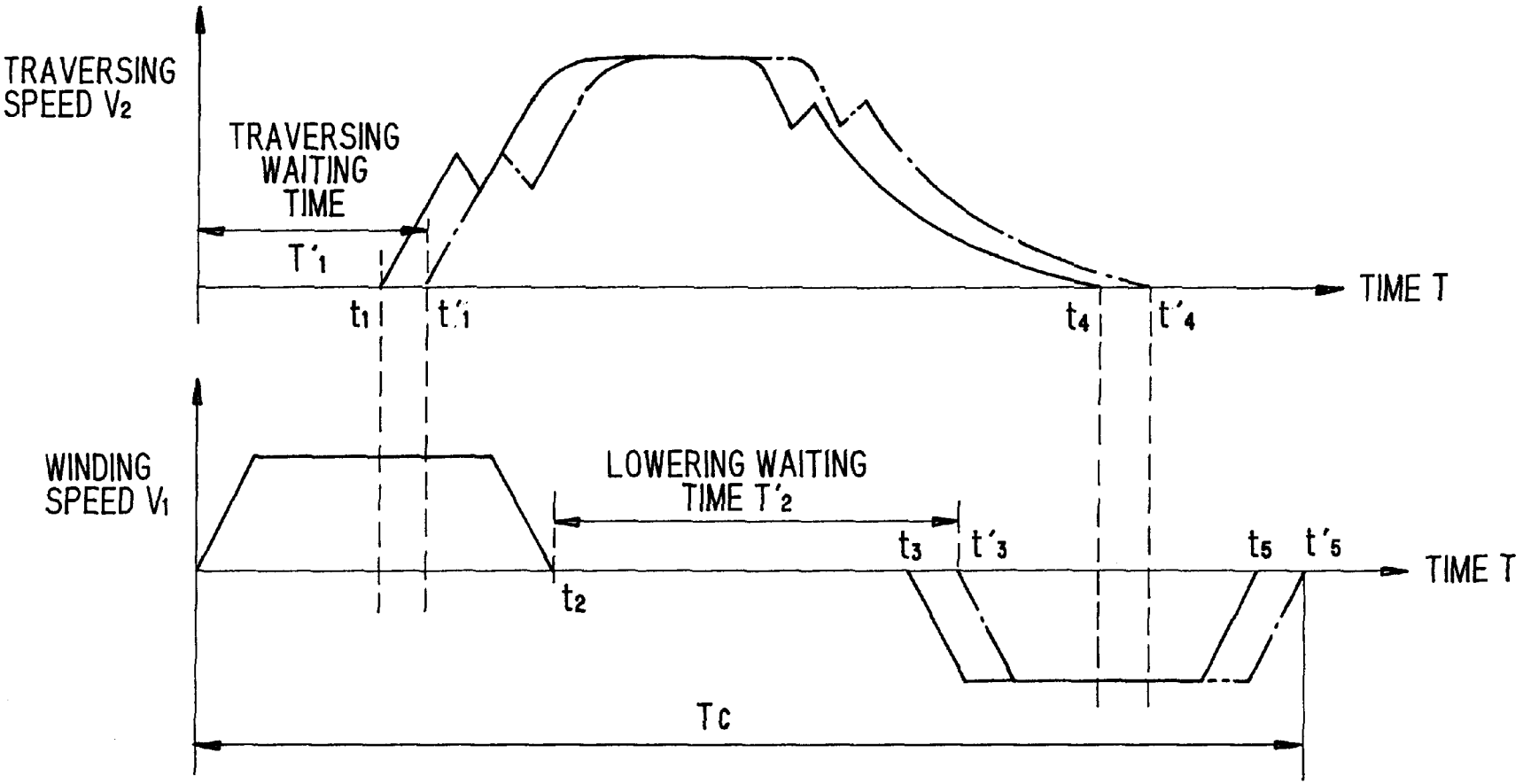
FIG. 4 is an explanation drawing of each speed pattern in the simultaneous winding/traversing operation of Mode 2 illustrated in FIG. 3.

FIG. 3 is an explanation drawing showing another example of a simultaneous winding/traversing operation status of a crane to which a cargo handling path setting method (apparatus) related to the embodiment of the invention is applied (Mode 2). FIG. 4 is an explanation drawing of each speed pattern in the simultaneous winding/traversing operation of Mode 2 illustrated in FIG. 3.

The simultaneous winding/traversing operation of Mode 2 illustrated in FIG. 3 shows a case in which when a suspended load n is carried from a location (a) in FIG. 3 to a location (b) over stacked loads n, the stacked loads n during the carriage of the suspended load n are stacked high nearer to the location (a) than the stacked loads n shown in FIG. 1.

When the stacked loads n are stacked high nearer to the location (a) as shown in FIG. 3, assume that the suspended load n passes along the same cargo handling path $\mathbf{1}_1$ as mentioned earlier (see FIG. 1). In this case, during the simultaneous execution of a hoisting action and a traversing action (at this time, swing is imposed on the suspended load n according to the traversing action), or at a sudden stop, the suspended load n swings, colliding with any of the stacked loads n lying on the location (a) side.

As shown in FIG. 4, therefore, compared with each speed pattern in the case of the cargo handling path $\mathbf{1}_1$ (see FIG. 2), the traversing starting time point for the trolley 3 (suspended load n) is delayed from $t_1$ to $t_1'$ to prolong the traversing waiting time $T_1'$ somewhat. Similarly, the lowering starting time point for the suspended load n is delayed from $t_3$ to $t_3'$ to prolong the lowering waiting time $T_2'$ somewhat. By this measure, the suspended load n is caused to follow a cargo handling path of a trajectory $\mathbf{1}_2$ as shown in FIG. 3.

In the simultaneous winding/traversing operation of this Mode 2, the time $T_c$ required for one cycle of actions for carrying the suspended load n is longer than the time $T_b$ required in the simultaneous winding/traversing operation of Mode 1, because the lowering waiting time $T_2'$ becomes somewhat longer. However, the time $T_c$ is sufficiently shorter than the required time $T_a$ for the right-angled operation (see FIG. 12).

Figure 5:
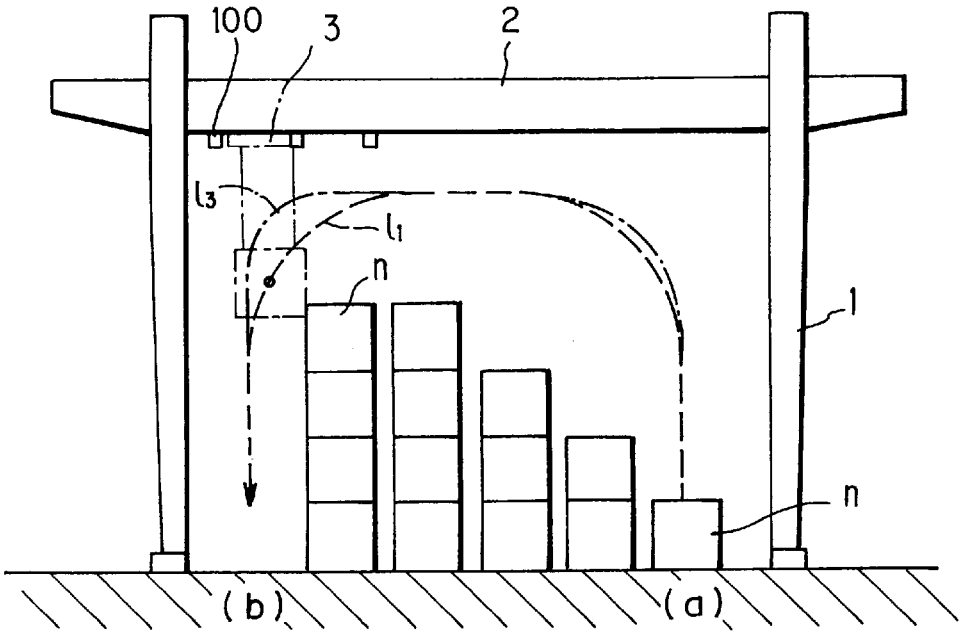
FIG. 5 is an explanation drawing showing still another example of a simultaneous winding/traversing operation status of a crane to which a cargo handling path setting method (apparatus) related to the embodiment of the invention is applied (Mode 3)
Figure 6:
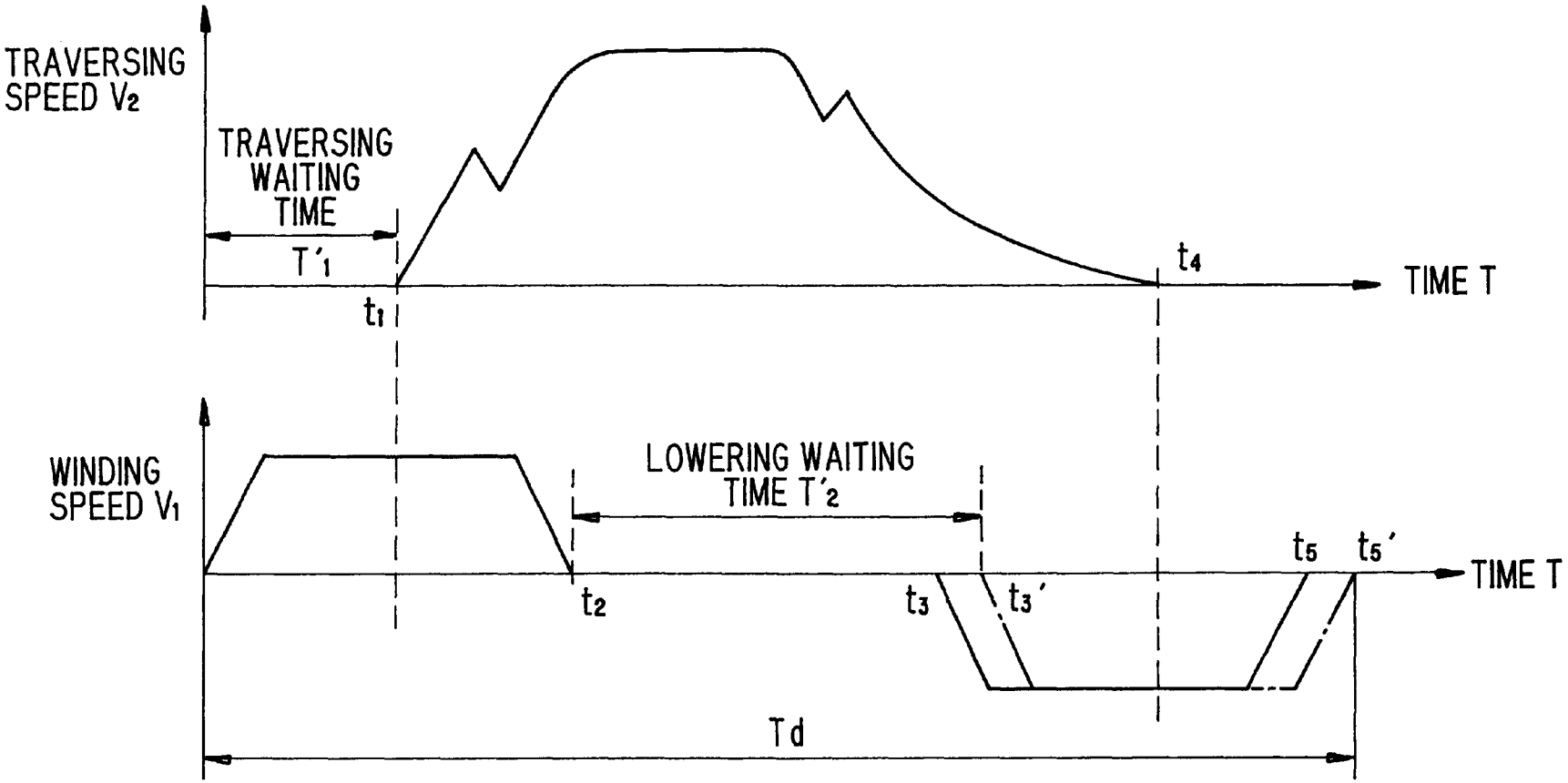
FIG. 6 is an explanation drawing of each speed pattern in the simultaneous winding/traversing operation of Mode 3 illustrated in FIG. 5.

FIG. 5 is an explanation drawing showing still another example of a simultaneous winding/traversing operation status of a crane to which a cargo handling path setting method (apparatus) related to the embodiment of the present invention is applied (Mode 3). FIG. 6 is an explanation drawing of each speed pattern in the simultaneous winding/traversing operation of Mode 3 illustrated in FIG. 5.

The simultaneous winding/traversing operation of Mode 3 illustrated in FIG. 5 shows a case in which when a suspended load n is carried from a location (a) in FIG. 5 to a location (b) over stacked loads n, the stacked loads n during the carriage of the suspended load n are stacked high nearer to the location (b) than the stacked loads n shown in FIG. 1.

When the stacked loads n are stacked high nearer to the location (b) as shown in FIG. 5, assume that the suspended load n passes along the same cargo handling path $\mathbf{1}_1$ as mentioned earlier (see FIG. 1). In this case, during the simultaneous execution of a traversing action and a lowering action, or at a sudden stop, the suspended load n swings, colliding with any of the stacked loads n lying on the location (b) side.

As shown in FIG. 5, therefore, compared with each speed pattern in the case of the cargo handling path $\mathbf{1}_1$ (see FIG. 2), the traversing starting time point for the trolley 3 (suspended load n) remains $t_1$ to keep the traversing waiting time at $T_1'$. However, the lowering starting time point for the suspended load n is delayed from $t_3$ to $t_3'$ as in the case of the cargo handling path $\mathbf{1}_2$ (see FIGS. 3 and 4) to make the lowering waiting time $T_2'$ somewhat longer than for the cargo handling path $\mathbf{1}_1$. By this measure, the suspended load n is caused to follow a cargo handling path of a trajectory $l_3$ as shown in FIG. 5.

The time $T_d$ required for one cycle of actions for carrying the suspended load n in the simultaneous winding/traversing operation of this Mode 3 is also longer than the time $T_b$ required in the simultaneous winding/traversing operation of Mode 1, because the lowering waiting time $T_2'$ becomes somewhat longer. However, the time $T_d$ is sufficiently shorter than the required time $T_a$ for the right-angled operation (see FIG. 12).

As described above, the simultaneous winding/traversing operation of a crane makes it a precondition that the traversing waiting time, the lowering waiting time, etc. be suitably set (namely, the optimum cargo handling path for a suspended load be set) depending on the condition of obstacles present in the way during carriage to carry a suspended load n to a predetermined place in a short time without causing its collision with the obstacles. According to the present invention, this optimum cargo handling path for the suspended load is set by a theoretical simulation test prior to an actual operation.

Figure 7:
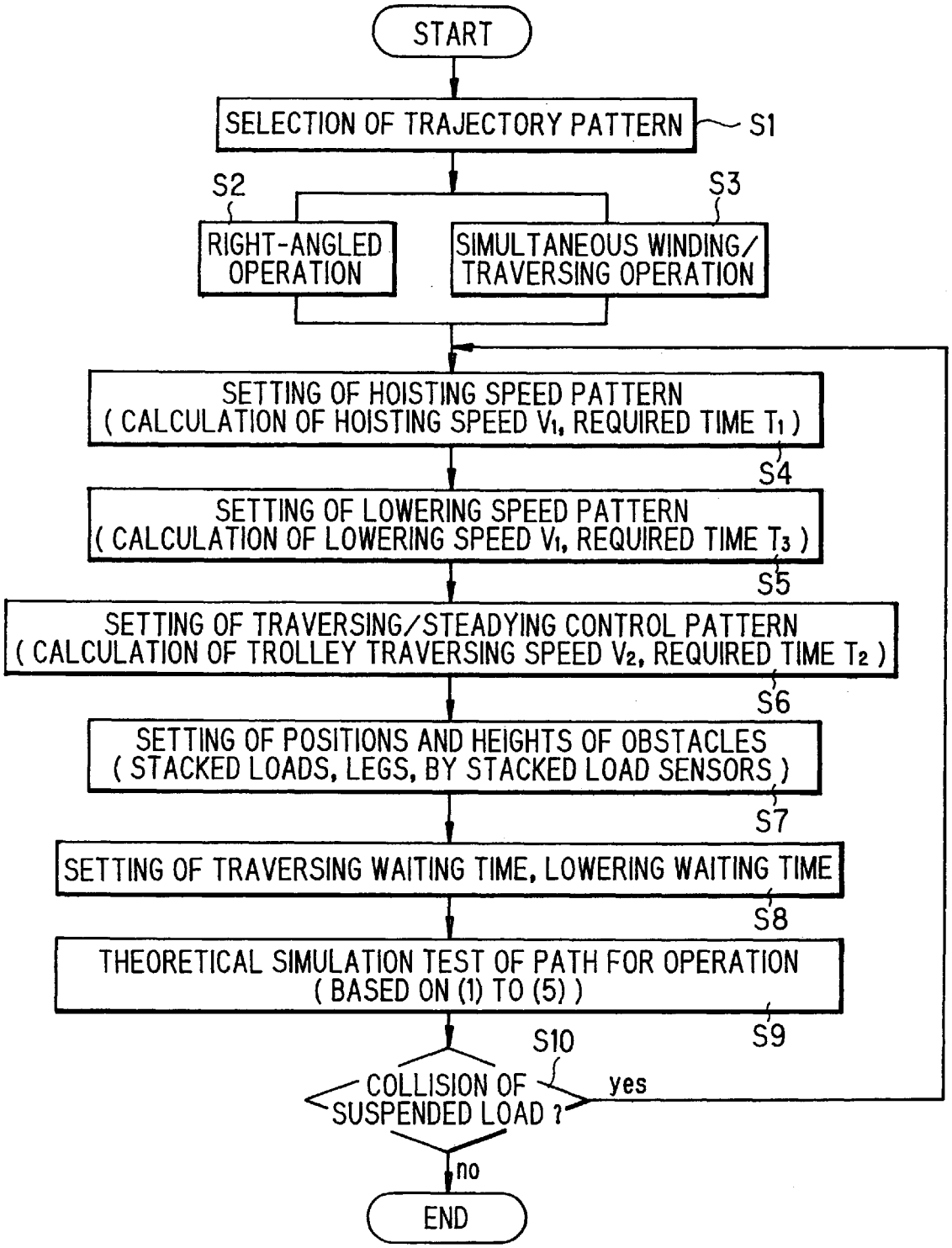
FIG. 7 is a flow chart showing the procedure for the cargo handling path setting method for a crane related to the embodiment of the invention.

FIG. 7 is a flow chart showing the procedure for the cargo handling path setting method for a crane related to the embodiment of the invention (the respective steps are assigned the symbols S1, S2, and so on).

As shown in this drawing, a simultaneous winding/traversing operation pattern is selected as a trajectory pattern for a suspended load n (see S1, S2 and S3).

Then, tentative set values are determined for a certain arbitrary cargo handling path model (e.g., the cargo handling path $\mathbf{1}_1$ shown in FIG. 1). That is, the following setting steps (1) to (5) are taken (see S4 to S8)

(1) Determine the hoisting speed $v_1$ for the suspended load n and the time $T_1$ required for hoisting to set a hoisting speed pattern.

(2) Deter mine the lowering speed $v_1$ for the suspended load n and the time $T_3$ required for lowering to set a lowering speed pattern.

(3) Determine the traversing speed $v_2$ for the trolley 3 (suspended load n) and the time $T_2$ required for traversing to set a traversing speed pattern (steadying/positioning control pattern).

(4) Based on data obtained using the stacked load sensors 100, set the positions and heights of obstacles such as the stacked loads n present around the cargo handling path, and those of the legs 1.

(5) Set the traversing waiting time and the lowering waiting time.

Then, a theoretical simulation test (calculation) is performed based on the above set conditions to compute a cargo handling path for the suspended load and the amount of swing of the suspended load (including that when an abnormality occurred and the trolley 3 stopped abruptly)

Assume this computation shows that the suspended load n passing along this cargo handling path swings during the simultaneous execution of a hoisting action and a traversing action, for example, as shown in FIG. 3, or at a sudden stop, whereupon the suspended load n collides with the stacked loads n placed on the location (a) side. In this case, the traversing starting time point and the lowering starting time point are slightly delayed, or other set values are properly revised, and a theoretical simulation test is conducted again. This procedure is repeated to set an optimum cargo handling path for the state of the obstacles present in the way during carriage, namely, the optimum cargo handling path by which the suspended load can be carried to a predetermined place in the shortest time required without the collision of the suspended load with the obstacles (e.g., the cargo handling path $1_2$ shown in FIG. 3) (see S9 and S10).

By applying the optimum cargo handling path set above to an actual operation, the suspended load n can be carried to a predetermined place in the shortest time required by the simultaneous winding/traversing operation without the collision of the suspended load n with the obstacles. Thus, safe and efficient cargo handling can be carried out.

Figure 8:
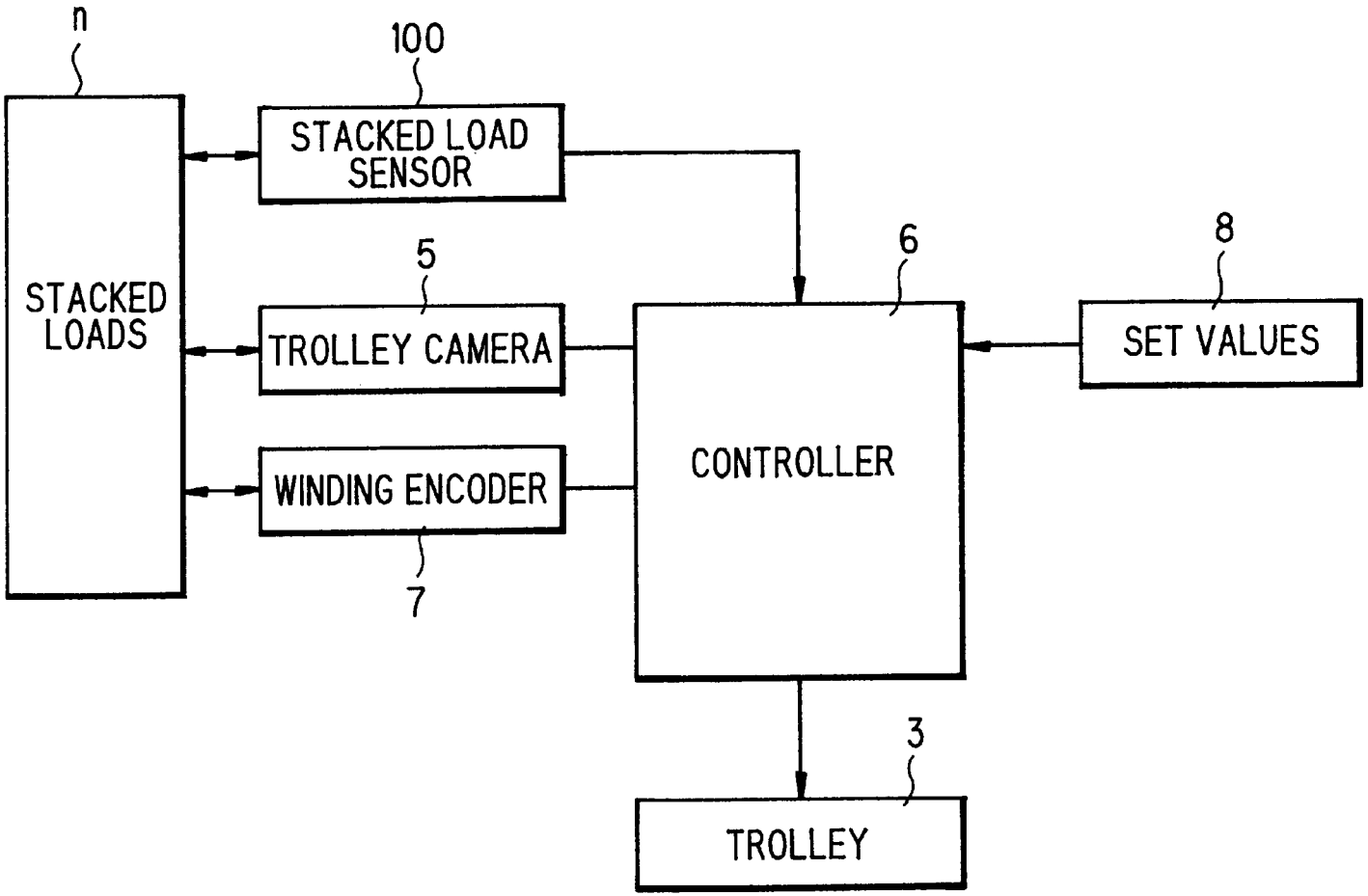
FIG. 8 is a block diagram showing the constitution of an apparatus using the cargo handling path setting method of the invention.

FIG. 8 is a block diagram showing the constitution of an apparatus using the cargo handling path setting method of the present invention. As shown in this drawing, this apparatus is composed of a trolley camera 5 for detecting the position of stacked loads n, a winding encoder 7 mounted on a wire drum to detect the height of the stacked loads n, a stacked load sensor 100, and a controller 6 which computes a cargo handling path for the suspended load n and the amount of swing of the suspended load n based on the values of detections by these devices and the respective set values 8 to judge and display whether the suspended load n will collide with the obstacles, sets an optimum cargo handling path, and controls the movement of the trolley 3 based on its output signal during an actual operation.

Figure 9:
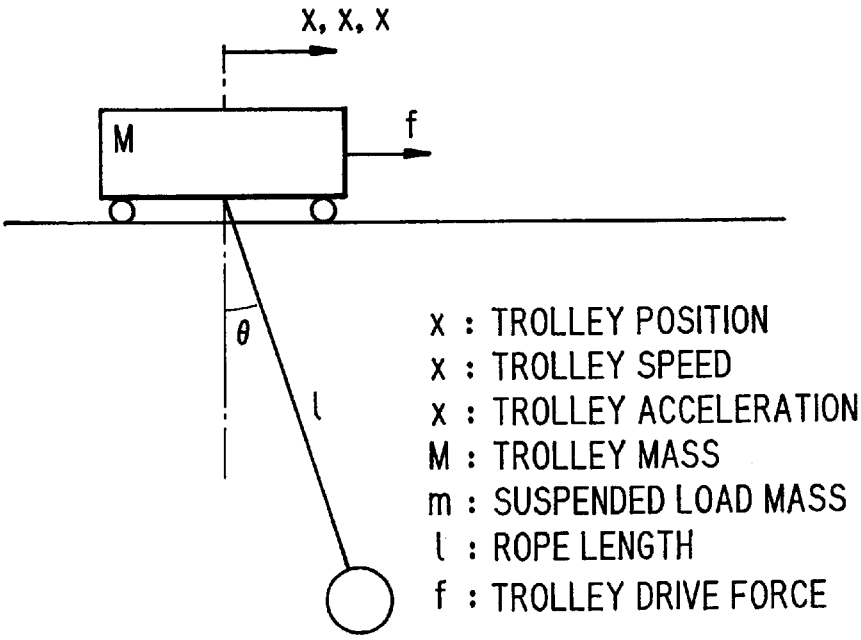
FIG. 9 is an explanation drawing showing a model of a crane involved in a theoretical simulation test.
Figure 10:
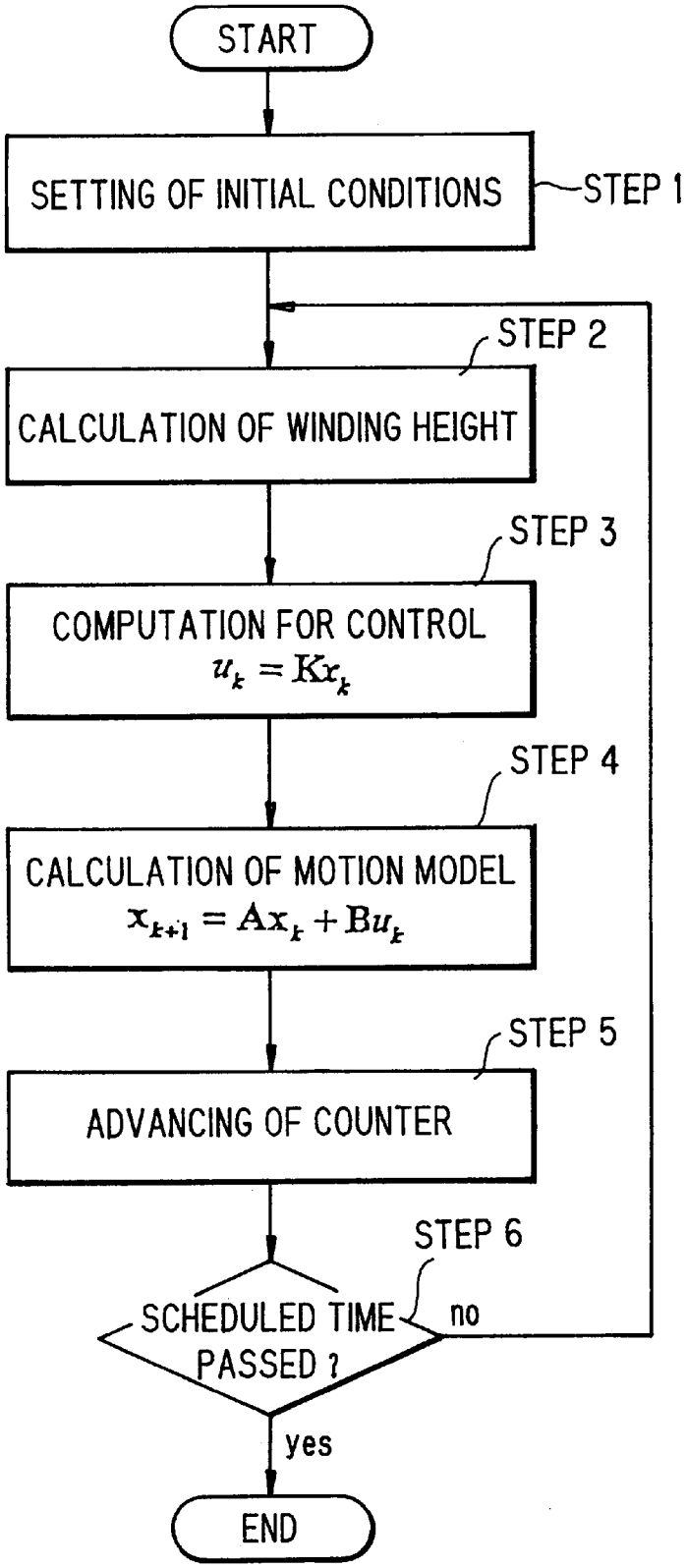
FIG. 10 is a flow chart showing the contents of processings in the theoretical simulation test.

The contents of processings in the theoretical simulation test will be described in detail based on FIGS. 9 and 10. FIG. 9 is an explanation drawing showing a model of a crane involved in the theoretical simulation test. FIG. 10 is a flow chart showing the contents of processings in the theoretical simulation test. The theoretical simulation test is conducted in the order of Steps 1 to 6 shown in FIG. 10.

[Step 1]

Initial conditions in the theoretical simulation test are set.

(1) Resetting of a counter for computing period.

(2) Setting of the initial value of the winding height of a suspended load.

[Step 2]

The winding height at each computing period is calculated from the integral calculation of the preset hoisting and lowering speed patterns and the initial value of the winding height.

[Step 3]

Computation for feedback control is performed. The trolley speed $u_k$ as the manipulated variable is calculated. K is a feedback gain, and $x_k$ is a state vector including the trolley position, the trolley speed, the swing displacement, and the swing speed as the state variables.

$$u_k = Kx_k$$

[Step 4]

Based on a motion model of the crane, simulation on the trolley and the pendulum is performed. The motion model uses a state space model derived from the equation of motion.

$$x_{k+1} = Ax_k + Bu_k$$

A is a transition matrix, while B is a drive matrix. A and B are constituted such that the parameters can be varied with the winding height to permit responses to changes in the model by changes in the rope length.

[Step 5]

The counter for measuring the computing time is advanced.

[Step 6]

It is determined whether the computing time has passed the scheduled time or not. If the scheduled time has been passed, the simulation is completed.

An example of deriving the state space model in Step 4 will be shown below. As indicated in FIG. 9, the crane is considered a motion model comprising a trolley and a simple pendulum. The equations of motion are expressed as the following two equations:

$$M\ddot{x} = mg\theta + f$$

$$l\ddot{\theta} = -g\theta - \ddot{x}$$

From these equations of motion and the following equation showing a speed control system for the trolley to be a PI control system, $$f = K_p(u - \dot{x}) + \frac{K_p}{T_i}\int (u - \dot{x})dt$$

let the integral of the error between the trolley speed command value and the trolley speed be $$e_i = \int (u - \dot{x})dt$$

and the state vector be $$X = [x, x, d, d, e_i]$$

Thus, the state equation is given by $$\frac{d}{dt}\begin{bmatrix} x \\ \dot{x} \\ d \\ \dot{d} \\ e_i \end{bmatrix} = \begin{bmatrix} 0 & 1 & 0 & 0 & 0 \\ 0 & -\frac{K_p}{M} & \frac{mg}{Ml} & 0 & \frac{K_p}{T_i M} \\ 0 & 0 & 0 & 1 & 0 \\ 0 & \frac{K_p}{M} & -\frac{(m+M)g}{Ml} & 0 & -\frac{K_p}{T_i M} \\ 0 & -1 & 0 & 0 & 0 \end{bmatrix}\begin{bmatrix} x \\ \dot{x} \\ d \\ \dot{d} \\ e_i \end{bmatrix} + \begin{bmatrix} 0 \\ \frac{K_p}{M} \\ 0 \\ -\frac{K_p}{M} \\ 1 \end{bmatrix} u$$

To enable calculation by sequential computation, the state equation is made discrete into the following form $$x_{k+1} = Ax_k + Bu_k$$

The control rule indicated in the Step 3 can utilize state feedback by optimal regulators which can be derived from this state space model. The control rule in this case can be expressed as $$u_k = Kx_k$$

As described concretely above along with the embodiment of the present invention, the cargo handling path setting method and apparatus of the invention determine arbitrary hoisting and lowering speeds of the suspended load and the times required for hoisting and lowering to set hoisting and lowering speed patterns, determine an arbitrary traversing speed of the suspended load and the time required for traversing to set a traversing speed pattern, set the positions and heights of obstacles present around the cargo handling path based on data from sensors, and further set an arbitrary waiting time for traversing and an arbitrary waiting time for lowering;

then conduct a theoretical simulation test based on these set conditions to compute a cargo handling path, and if it is determined that the suspended load passing along the cargo handling path will collide with the obstacles, repeat the procedure of revising the set conditions and conducting a theoretical simulation test again;

thereby setting an optimum cargo handling path by which the suspended load can be carried to a predetermined place in the shortest time required without the collision of the suspended load with the obstacles.

By applying the optimum cargo handling path set above to an actual operation, the suspended load can be carried to a predetermined place in the shortest time required by the simultaneous winding/traversing operation without the collision of the suspended load with the obstacles. Thus, safe and efficient cargo handling can be carried out.

What is claimed is:

1. A cargo handling path setting method for a crane adapted to set an optimum cargo handling path for the simultaneous winding/traversing operation of a suspended load by a crane which hoists the suspended load by a hoisting/lowering structure, traverses the suspended load by a traversing structure, and lowers the suspended load by the hoisting/lowering structure to carry the suspended load to a predetermined place, said method comprising:

determining arbitrary hoisting and lowering speeds of the suspended load and the times required for hoisting and lowering to set hoisting and lowering speed patterns, determining an arbitrary traversing speed of the suspended load and the time required for traversing to set a traversing speed pattern, setting the positions and heights of obstacles present around the cargo handling path based on data from sensors, and further setting an arbitrary waiting time for traversing and an arbitrary waiting time for lowering such that a portion of the hoisting speed pattern occurs simultaneously with a portion of the traversing speed pattern, and a portion of the traversing speed pattern occurs simultaneously with a portion of the lowering speed pattern;

then conducting a theoretical simulation test based on these set conditions to compute a cargo handling path, and if it is determined that the suspended load passing along the cargo handling path will collide with the obstacles, repeating the procedure of revising the set conditions and conducting a theoretical simulation test again;

thereby setting an optimum cargo handling path by which the suspended load can be carried to a predetermined place in the shortest time required without the collision of the suspended load with the obstacles.

2. The cargo handling path setting method according to claim 1, wherein when it is determined that the suspended load passing along the cargo handling path calculated by means of the theoretical simulation test will collide with the obstacles on the hoisting side, the waiting time for traversing is increased in order to shorten the overlap period between the hoisting speed pattern and the traversing speed pattern; when it is determined that the suspended load will collide with the obstacles on the lowering side, the waiting time for lowering is increased in order to shorten the overlap period between the traversing speed pattern and the lowering speed pattern; and the theoretical simulation test is performed again.

3. The cargo handling path setting method of claim 1, wherein said method sets an optimum cargo handling path where a suspended load can be carried to a predetermined place in the shortest time required by the simultaneous winding/traversing operation without the collision of the suspended load with obstacles.

4. The cargo handling path setting method of claim 1, wherein the cargo handling path gives sufficient clearance to avoid a collision with obstacles due to swinging by the suspended load.

5. A cargo handling path setting apparatus for a crane adapted to set an optimum cargo handling path for the simultaneous winding/traversing operation of a suspended load by a crane which hoists the suspended load by a hoisting/lowering structure, traverses the suspended load by a traversing structure, and lowers the suspended load by the hoisting/lowering structure to carry the suspended load to a predetermined place, said apparatus comprising:

a condition setter for determining arbitrary hoisting and lowering speeds of the suspended load and the times required for hoisting and lowering to set hoisting and lowering speed patterns, determining an arbitrary traversing speed of the suspended load and the time required for traversing to set a traversing speed pattern, setting the positions and heights of obstacles present around the cargo handling path based on data from sensors, and further setting an arbitrary waiting time for traversing and an arbitrary waiting time for lowering such that a portion of the hoisting speed pattern occurs simultaneously with a portion of the traversing speed pattern, and a portion of the traversing speed pattern occurs simultaneously with a portion of the lowering speed pattern; and an arithmetic device for conducting a theoretical simulation test based on these set conditions to compute a cargo handling path, and if it is determined that the suspended load passing along the cargo handling path will collide with the obstacles, repeating the procedure of revising the set conditions and conducting a theoretical simulation test again, thereby setting an optimum cargo handling path by which the suspended load can be carried to a predetermined place in the shortest time required without the collision of the suspended load with the obstacles.

6. The cargo handling path setting apparatus according to claim 5, wherein said arithmetic device is structured such that when it is determined that the suspended load passing along the cargo handling path calculated by means of the theoretical simulation test will collide with the obstacles on the hoisting side, said arithmetic device increases the waiting time for traversing in order to shorten the overlap period between the hoisting speed pattern and the traversing speed pattern; when it is determined that the suspended load will collide with the obstacles on the lowering side, said arithmetic device increases the waiting time for lowering in order to shorten the overlap period between the traversing speed pattern and the lowering speed pattern; and said arithmetic device subsequently performs the theoretical simulation test again.

* * * * *